United States Patent [19]

Fleissner

[11] Patent Number: 4,528,877

[45] Date of Patent: Jul. 16, 1985

[54] PROCESS AND APPARATUS FOR CUTTING BAND- OR SKEIN-SHAPED MATERIAL

[75] Inventor: Heinz Fleissner, Riehen/Basel, Switzerland

[73] Assignee: Fleissner GmbH & Co., Eglsbach, Fed. Rep. of Germany

[21] Appl. No.: 462,311

[22] Filed: Jan. 31, 1983

[30] Foreign Application Priority Data

Jan. 30, 1982 [DE] Fed. Rep. of Germany ..... 3203083

[51] Int. Cl.[3] ..... D01G 1/04; B02C 18/18; B02C 19/12

[52] U.S. Cl. ..... 83/37; 83/346; 83/913

[58] Field of Search ..... 83/913, 346, 347, 37; 19/0.6, 0.62, 0.64

[56] References Cited

U.S. PATENT DOCUMENTS 2,234,105 3/1941 Ashton et al. ..... 83/913 X
3,485,120 12/1969 Keith ..... 83/37
3,869,268 3/1975 Briar ..... 83/913 X
4,391,169 7/1983 Laird ..... 83/346 X

FOREIGN PATENT DOCUMENTS 2350540 4/1974 Fed. Rep. of Germany .
2609386 9/1977 Fed. Rep. of Germany .

*Primary Examiner*—James M. Meister
*Attorney, Agent, or Firm*—Antonelli, Terry & Wands

[57] ABSTRACT

A cutting apparatus consists of two cutter cages arranged in direct superposition, with radially outwardly oriented cutters onto which a textile material to be cut is wound in spiral shape and is cut by a pressure roller effective from the outside radially inwardly. The two cutter cages are constituted by cutter supporting disks attached to a spoked wheel; these disks carry cutters which simultaneously equip the upper and lower cutter cages. By using such an apparatus, it is possible to cut simultaneously two continuous strands with only a single device. It is also possible to arrange more than only two cutter cages in superposition at one apparatus.

5 Claims, 2 Drawing Figures

PROCESS AND APPARATUS FOR CUTTING BAND- OR SKEIN-SHAPED MATERIAL

Figure 1:
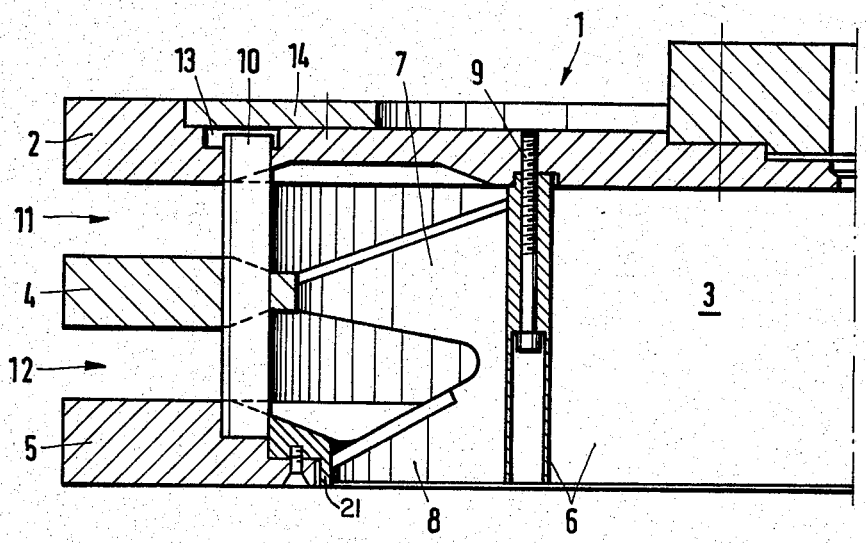

This invention relates to a process and apparatus for cutting band- or skein-shaped fiber-containing textile material, especially for the production of staple fibers, wherein the textile material; e.g., a yarn or sliver, to be cut is fed to a cutter roll having a plurality of radially oriented cutting knives and is severed by a force effective in the radial direction between the material and the cutter roll, said force being provided by a package wound with radially superimposed laps or wraps that is continuously formed from the material to be cut, in such a way that the material, respectively, newly fed to the cutter roll forms the lap of the package radially farthest away from the blades and that continuously the lap lying farthest on the inside radially is severed by the blades.

One process of this type has been known from DOS (German Unexamined Laid-Open Application) No. 1,660,286 published Jan. 14, 1971. This process has found worldwide acceptance in the synthetic fiber industry for the manufacture of staple fibers. With the aid of this process, staple fibers can be produced of substantially any desired length. This holds true, in particular, for staple lengths larger than 6 mm. Since the cutters are exposed to a high cutting pressure, it is customary to mount the rear sides of the blades in a holder or reinforcing device whereby buckling stresses produced during cutting at the brittle cutters can be absorbed. However, these cutter holders interfere with the radially inwardly oriented removal of the cut fibers, since these holders additionally restrict the space which becomes ever narrower toward the inside of the cutter unit.

However, it is also known from DOS No. 2,350,540 published Apr. 18, 1974 to provide a cutter roll wherein the backs of the cutters are not rigidified by a holder but instead the cutters are braced mutually over the entire periphery of the cutter roll. One disadvantage in this construction is the fact that after destruction of one or a few additional cutters, the cutter roll in total becomes useless, since it is impossible to replace individual cutters without great disassembly expenditure.

Fiber manufacturing lines are designed for optimum production efficiency. The fiber strands; e.g., yarns or slivers, produced therein must be crimped by a continuous method in the state wherein the strands are delivered from the lines and then must also be cut into staple fibers. As a consequence, the supplied strand must be wound directly onto the cutter roll. It has been discovered under practical conditions that cutting of staple fibers shorter than 6 mm staple length is either impossible or possible only with difficulties by means of the process of the type heretofore described. Clogging of the spaces between the cutters occurs time and again; namely, even if the cutters are arranged without a back side between the two disks of the cutter cage.

This invention, based on the process of the type mentioned heretofore, has as its objective to develop a process permitting the severing of even thick, for example, 2,000,000 dtex thick, synthetic multifilament fiber strands delivered directly from the fiber manufacturing line continuously into short staple fibers without the drawback of having the mounting length of the cutters too great, thereby more rapid breakage of the cutters and clogging of the cutter wheels during the course of time. (It will be appreciated that the process of this invention can also be employed to form staple fibers from preformed packages of textile material if so desired.)

In order to attain the thus-posed objective, the invention provides that the multi-filament yarn or strand delivered by the fiber manufacturing line and being fed to the cutting machine is divided in the longitudinal direction at least once in its length prior to production of the wound package, and the partial quantities of filaments or continous fibers are introduced simultaneously to the cutter roll for the production of at least two wound packages which are separate from each other but in direct mutual superposition. Thus, the bulk of a strand is diminished in a simple way by the measure of this invention so that the strand, which may initially be thick, is converted into at least two thin strands and is only then fed to the cutter roll for the production of staple. Such thin strands can also be processed more readily into a staple length of below 6 mm, since the amount of fiber per length of effective cutter portion, to be removed in this case from between the cutters, is correspondingly reduced.

It is, of course, just as well possible, according to the process of this invention, to cut, instead of one strand divided in the longitudinal direction, two strands of a correspondingly smaller thickness simultaneously at the two superimposed wound packages. In any event, with the use of this method, only one device with only a single drive mechanism and the like is required, although several strands or slivers are cut and several rolled packages are produced therefor. The essential factor is that in this case the effective length of the cutters (i.e., the radial length) can be smaller as compared to the prior art, whereby the cutter-destroying bending forces can be more readily absorbed by the cutter support or holder.

An apparatus is disclosed in DOS No. 2,609,386 published Sept. 8, 1977 wherein a cutter cage wrapped around by a sliver repeatedly is arranged, with at least two axially superposed cutter cages; between the cutter support disks of these cages, a plurality of radially outwardly oriented knives is held at a spacing corresponding to the desired staple. Pressure rolls to obtain the radially inwardly acting cutting pressure on the wound up sliver are associated on the outside at a spacing with these cutter cages. The apparatus serves for the production of a variety cut; i.e., wherein simultaneously varying staple lengths are produced and mingled. Such an apparatus serves very advantageously also for conducting the process of this invention. In one embodiment of this invention, the provision is made to make the knives for the superposed cutter cages of one piece and pass them through the combined, optionally central cutter support disk. In the apparatus of this invention, of course, identical staple lengths are to be produced at the superpositioned cutter cages. It is, therefore, advantageous to use only one cutter for both cutter cages, which cutter is inserted through appropriate slots in the cutter supporting disks and can readily be fixed in place in both cutter cages. Due to the less thick strand (sliver), the spacing between the cutter support disks and/or the effective part of the cutters can be smaller. Accordingly, the bending forces arising during cutting will not become fully effective. In any event, the cutters will not buckle due to the smaller mounting width, thereby reducing the danger of breakage. Consequently, it is readily possible in one embodiment of the apparatus of the invention to utilize even backless cutters without any problem. This, as described above, is of substantial importance for the removal of the staples, especially in case of short staples.

It is also possible in a simple way in the apparatus of this invention to exchange individual cutters between the cutter support disks. The cutter cage is advantageously fashioned as a self-supporting element by mounting the cutter support disks, for example, at the uppermost disk, by way of a spoked wheel which is a twin wheel in the present invention. Thus, the cutters (i.e., the cutting blades) are supported along the extreme cutter supporting disks in the longitudinal as well as radial directions while the cutters are held, in the central cutter support disk, merely by shape mating in the radial direction.

Figure 2:
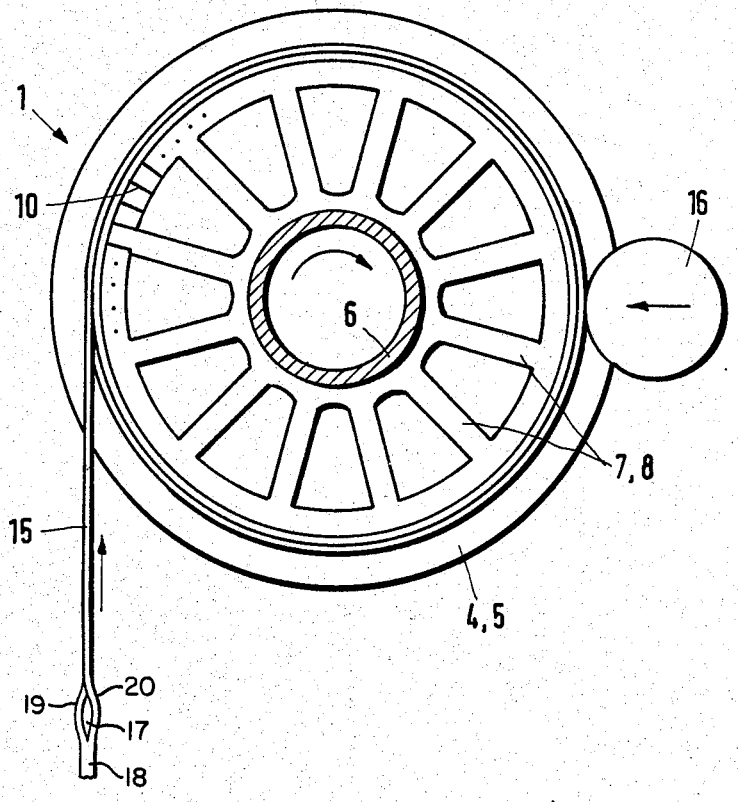

The drawings show one embodiment of the apparatus according to this invention, wherein:

FIG. 1 shows a vertical section taken transversely through the left-hand portion of a cutter wheel; and FIG. 2 shows a top view of a lower part of the cutter wheel shown in FIG. 1.

The staple fiber cutting apparatus of this invention comprises a horizontally arranged cutter roll, denoted by reference numeral 1 in its entirety, having an upper cutter support disk 2 and a spoked wheel 3 arranged therebelow. Two additional cutter support disks 4 and 5 are arranged in superimposed relationship at the spoked wheel 3. For this purpose, the spoked wheel 3 includes an inner cylinder 6. As shown in FIG. 2, the cutter supporting disk 4 is attached to the spokes 7 of this cylinder and the cutter support disk 5 is mounted to the spokes 8 located therebelow. The spoked wheel 3 is threadedly secured from the bottom by means of screws 9 to the cutter support disk 2, thus making the cutter roll or wheel 1 a unit.

In the upper cutter support disk 2, radially oriented slots are provided radially outside of the hub of the spoked wheel. These slots are continued exactly in the axial direction of the cutter wheel in the cutter support disks 4 and 5. The size of the slots corresponds to that of the cutter in the form of a cutting knife or blade 10 which knife is pushed from the top toward the bottom through these slots and fixed in the downwardly closed slot of the cutter support disk 5. Thus, the single knife 10 provides cutting means for the upper cutter cage 11 as well as the lower cutter cage 12. A small annular groove 13 is worked into the upper cutter support disk 2 in the zone of the slots for the knives, so that it is easy for the operator to seize the upper edge zone of the cutters and, thus, to pull out and/or insert the cutters. The annular groove 13 is sealed in the upward direction by a lid 14 during operation of the apparatus. The cutter support disk 5, according to FIG. 1 is joined by screws to a portion of the wheel body 21 having a slot for accommodating the knife 10. The slot is closed by the cutter support disk 5 so that the knives are supported in the downward direction.

As can be seen from FIG. 2, respectively, one yarn strand or sliver 15 is wound in spiral form onto the cutter cages 11 and 12. According to the invention, a thicker yarn strand or sliver 18 is first to be divided onece with respect to its bulk in the longitudinal direction; for this purpose, a resistance member 17 is placed in the path of the traveling strand 18. By this resistance member the yarn strand is halved along its length and a portion 19 is fed to the upper cutting cage and, respectively, another portion 20 (corresponding to strand 15) is fed to the lower cutting cage 12. By the radially inwardly directed pressure of the pressure roller 16, the laps of the strand are urged against the blades of the cutters, thereby are severed, and are pushed into the throat between the backless (i.e., free of reinforcement) knives 10. This throat space is conically widened with respect to the width between the cutter support disks 2 and 4 and/or 4 and 5. This can be seen from the broken lines in FIG. 1 at the level of the knives 10. On account of the illustrated construction; i.e., the knives 10 are arranged in close mutual proximity, the knives do not have any reinforcements along the longitudinal edge in opposition to the cutting surface.

In the conically flaring space of the throat, the cut fibers are pushed unhindered into the space between the spokes and then fall due to their weight between the spokes downwardly.

The advantage of the illustrated apparatus consists in the arrangement of a device consisting of two cutting cages, wherein merely one knife needs to be inserted from above to equip both cutting cages. Worn cutters can be readily replaced and, with a short effective length in operation, are fixedly held at three points. This considerably precludes buckling and, thus, breakage of the cutting knives.

What is claimed is:

1. A process for cutting a thick strand of textile material in the form of multifilament sliver or yarn for the manufacture of staple fibers, which comprises feeding the strand of textile material to be cut directly from a unit for manufacturing the sliver or yarn to a cutter roll having at least two cutter cages each provided with a plurality of radially oriented cutting means for cutting the textile material into staple fibers of a desired length by a force acting in the radial direction between the textile material and the cutter roll; dividing the strand of textile material at least once in the longitudinal direction into a plurality of divided portions of the strand; feeding each divided portion of the strand simultaneously to separate cutter cages of the cutter roll; and forming a rolled package with radially superimposed wraps continuously from each divided portion of the material to be cut so that the material, respectively, newly fed to the cutter roll forms the wrap of the package radially farthest away from the cutting means and so that continuously the wrap laying radially farthest on the inside of the package is cut by the cutting means; the divided portions of the strand fed simultaneously to the cutter roll producing at least two packages which are separated from each other but which are in direct mutual superposition on said cutter roll.

2. An apparatus for producing staple fibers which comprises a cutter roll having at least two cutter cages arranged in axially aligned superposed position, each of said cages including cutter supporting disks, and a plurality of radially outwardly oriented cutters arranged between the cutter supporting disks and held at a spacing from each other corresponding to the desired staple length, said cutter cages being associated with and being spaced from a pressure roll means for obtaining the radially inwardly effective cutting pressure for the rolled-up divided portion of a strand to be wound on each cutter cage, and said cutters comprising knives for the superposed cutter cages that are each made of one piece and are passed through a common cutter support disk which is centrally located on the cutter roll; said common cutter support disk being arranged between two superposed cutter cages whereby at least two rolled packages of divided portions of the strand of textile material are arranged separately from each other in superposition on said cutter roll.

3. An apparatus according to claim 2, wherein said cutter roll comprises two outermost cutting disks and a central cutter disk, the knives are held between the cutter support disks to be individually exchangeable; namely, at the outermost disks in the longitudinal and radial directions and in the central disk in a shape-mating fashion solely in the radial direction.

4. An apparatus according to claim 2, wherein in one of said cutter cages one of the cutter support disks of said one cutter cage is integral with another cutter support disk by way of a spoked wheel, said spoked wheel being doubled and encompassing the central cutter support disk and one of the outermost cutter support disks.

5. An apparatus according to claim 2, further comprising means for dividing a strand of textile material at least once in the longitudinal direction into a plurality of divided portions of the strand, each of the divided portions being directed to a separate superposed cutter cage on said cutter roll.

* * * * *